US006988430B1

(12) United States Patent
Putney et al.

(10) Patent No.: US 6,988,430 B1
(45) Date of Patent: Jan. 24, 2006

(54) WRENCH WITH FLEXIBLE RING

(75) Inventors: Gordon A. Putney, Lake Geneva, WI (US); Daniel M. Eggert, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 255 days.

(21) Appl. No.: 10/342,696

(22) Filed: Jan. 15, 2003

Related U.S. Application Data

(60) Provisional application No. 60/349,201, filed on Jan. 16, 2002.

(51) Int. Cl.
*B25B 13/52* (2006.01)

(52) U.S. Cl. ..... 81/64; 81/60

(58) Field of Classification Search ..... 81/64, 81/3.43, 60, 58.5, 438, 439
See application file for complete search history.

(56) References Cited

U.S. PATENT DOCUMENTS

| | | | |
|---|---|---|---|
| 208,057 | A | 9/1878 | Beck |
| 324,378 | A | 8/1885 | Hayden |
| 1,192,136 | A | 7/1916 | Stone |
| 1,405,795 | A | 2/1922 | Meyer |
| 1,464,128 | A | 8/1923 | Coes |
| 1,536,011 | A | 4/1925 | Jones et al. |
| 1,664,391 | A | 4/1928 | Ashcroft |
| 2,081,383 | A | 5/1937 | Rector |
| 2,487,987 | A | 11/1949 | Schmitt et al. |
| 2,764,049 | A | 9/1956 | Hartung |
| 2,766,648 | A | 10/1956 | Jazwieck |
| 2,824,476 | A | 2/1958 | Wilson |
| 2,834,239 | A | 5/1958 | Mancini |
| 2,991,545 | A | 7/1961 | Wuischpard |
| 3,590,668 | A | 7/1971 | Bristol |
| 3,656,376 | A | 4/1972 | Campbell et al. |
| 3,875,828 | A | 4/1975 | Evans |
| 3,905,255 | A | 9/1975 | Evans |
| 3,969,962 | A | 7/1976 | Campbell |
| 4,130,032 | A | 12/1978 | Giandomenico et al. |
| 4,222,293 | A | 9/1980 | Schreyer et al. |
| D268,984 | S | 5/1983 | Bergen |
| 4,504,087 | A | 3/1985 | Pennington |
| 4,517,862 | A | 5/1985 | Garcia |
| 4,688,454 | A | 8/1987 | Scull |
| 4,774,862 | A | 10/1988 | Scull |
| 4,913,008 | A | 4/1990 | Snyder |
| 4,967,612 | A | 11/1990 | Sparling |
| 4,970,919 | A | 11/1990 | Snyder |
| 5,653,151 | A * | 8/1997 | Blacklock ..... 81/60 |

(Continued)

*Primary Examiner*—Lee D. Wilson
(74) *Attorney, Agent, or Firm*—Seyfarth Shaw LLP

(57) ABSTRACT

A ratchet wrench is provided having a flexible ring forming the head where the flexible ring may have serrations on its inner surface and forms a free end having a pawl thereon. The flexible ring is formed as one piece with the handle of the wrench. Upon tightening, the flexible ring will tighten down on a fastener and upon a non-tightening rotation, the pawl will ratchet against the corners of the fastener according to the self energizing geometry of the wrench where an arc is provided on a shoe of the handle which is eccentric to the arc of the flexible ring. In an embodiment, a gear insert is provided within the flexible ring for engagement with the fastener, torquing and ratcheting of the flexible ring being relative to the gear insert. In an embodiment, the a insert may be provided that has a substantially smooth outer surface including circumferential engagement features for engaging a substantially smooth facing surface of the flexible ring.

45 Claims, 6 Drawing Sheets

U.S. PATENT DOCUMENTS 5,709,137 A * 1/1998 Blacklock ..... 81/467
5,713,248 A * 2/1998 Franco ..... 81/3.43
D405,344 S 2/1999 Peabody
6,237,448 B1 5/2001 Haxton
6,308,595 B1 10/2001 Georgeson
6,397,706 B1 * 6/2002 Maznicki ..... 81/121.1

* cited by examiner

WRENCH WITH FLEXIBLE RING

RELATED APPLICATION

This application claims the benefit of the earlier filing date of provisional application Ser. No. 60/349,201, filed Jan. 16, 2002.

BACKGROUND

This application relates to hand tools and, more particularly, to ratcheting wrenches. Ratchet wrenches have been provided generally with multiple elements, such as pawls and levers, located in the head of the wrench to permit ratcheting and to control direction. These constructions generally require complex assembly and manufacturing processes. For example, a common type ratchet wrench, such as Snap-on, Inc., model no. F872 round head ratchet, provides for selective ratcheting in either direction. The wrench includes cam surfaces of the pawl that are designed to allow for tightening of a socket while the cam is in a first position allowing rotation only in one direction, such as clockwise. When the wrench is rotated in a counterclockwise direction a gear rotates and ratchets.

Wrenches that provide large amounts of torque that are made of few components have been known. Examples are strap wrenches, ratcheting tube wrenches and pipe wrenches. Such wrenches may have pivots which require the wrench to be assembled of more than one piece. Also, wrenches such as strap wrenches require adjustment of the straps generally in order to provide sufficient amounts of torque. In addition, such wrenches are not easily manufactured through automated manufacturing processes.

Also such wrenches do not provide a proper geometry and construction to allow for the teeth or serrations in the head of the wrench to provide for dual functionality of torquing and also ratcheting. Generally, serrations that provide for torque must be large in order to take up the hoop stress imparted during torquing. Serrations that provide for ratcheting are generally small to allow for low torque so that the teeth may move on and off the corner of a fastener. No known wrenches provide a proper geometric construction that provide for serrations that have dual functionality of torquing and ratcheting. Therefore, a wrench is desired that has one major piece and provides for ratcheting and/or release of the fastener during non-torquing rotation.

SUMMARY

In an embodiment, a wrench is provided comprising a first end including a handle, a second end including a flexible ring having an inner surface having serrations and the flexible ring having an attached end integrally formed with the handle and a free end defining a pawl. The flexible ring may have flexibility and resilience such that when the wrench is rotated in a torquing direction the flexible ring flexes inwardly from a rest, unstressed position and wraps down on the fastener. When the wrench is rotated in a non-tightening direction, the flexible ring flexes outwardly from the rest position to allow the serrations to ratchet around the fastener. The attached end of the ring is coupled to the handle at a tensile load bearing portion and adjacent the tensile load bearing portion is a shoe which forms an arc that may abut the pawl. The shoe may provide a self energizing force against the pawl. The arc of the shoe may be eccentric relative to the arc formed by the outer surface of the ring, the arcs respectively having center points B and A, such that radii to the center points from a common point C cooperate with a line joining the centers to form an oblique triangle.

When the wrench is oriented in a rest condition so that the free end of the ring is located at about a six o'clock position with the handle down, and the center point A is located at the center of the ring, the center point B of the shoe arc is offset from center point A, being disposed between about the one o'clock and two o'clock positions. In an embodiment, the ring may include from about 6 to about 36 teeth forming serrations. In an embodiment where the wrench is ¾" nominal size, the ring may have 30 teeth. In an embodiment, a slit may be formed in the handle between the tensile load bearing portion and the shoe. The slit may have a hole formed at its closed end wherein the slit and the hole provide strain relief.

In an embodiment, the attached end of the ring may be attached to the handle at a tensile load bearing portion and adjacent the tensile load bearing portion is a shoe having an arcuate surface that may form an arc upon which the pawl may abut, and a slit may be formed in the handle between the tensile load bearing portion and the shoe. The slit may have a hole formed at its closed end wherein the slit and the hole provide a strain relief. In an embodiment, a gear insert may be located within the ring. The gear insert may include an outer surface having serrations adjacent to the serrations of the inner surface of the ring. The serrations of the outer surface may correspond in size and number to the serrations of the ring wherein, upon movement of the wrench in a non-tightening direction, the gear insert will ratchet relative to the gear insert. The gear insert may include a rim that rides on a shoulder of the ring, being held in place by a retaining ring. In an embodiment, the gear insert may be one piece and may be retained axially to the ring by a single retaining ring and resting in circumferential grooves present in both the gear insert and the ring at a midpoint of each of the gear insert and ring. The gear insert may include a torquing surface serration pattern on its inner surface. In an embodiment, the gear insert may include a hex torquing surface. In an embodiment the gear insert may include a double hex serration pattern on its inner surface. The gear insert may include one more serration on its outer surface than the number of serrations on the ring. The gear insert may be one piece.

In an embodiment, a method of manufacturing a wrench is provided comprising the steps of forming a one-piece wrench of steel having a handle and a solid disk integrally formed with the handle, removing a central portion of the disk to form a ring, heat treating the wrench and forming a free end of the ring by cutting an arc shaped separation and gap between the handle and the ring adjacent the gap to form a shoe on the handle and a pawl on the ring. The separation may be 0.010 inch. The steel in an embodiment may be 50 B 44 material. In an embodiment the method further comprises the steps of forming teeth in the solid disk by drilling and broaching prior to the heat treating. In an embodiment the method further comprises the steps of cutting by wire EDM, laser, water jet saw or other narrow slit-forming process. In an embodiment the material used may be composite including fiber reinforced plastic.

In an embodiment, a one-piece wrench is provided comprising a first end having a socket having, along an inner surface, means for applying torque, a pawl means for ratcheting against a fastener located within the socket and a self energizing means wherein, upon rotation of the wrench in a tightening direction, the socket will clamp down on a fastener. The torque applying means may include serrations on the socket. The self energizing means may include a resilient ring forming the socket, the ring having a free end that allows the ring to clamp down on the fastener. The pawl means may include the free end of the flexible ring having serrations thereon. The self energizing means may include a handle having a shoe engageable with the pawl means to urge the pawl means against a fastener located therein. In an embodiment the self energizing means may include a handle having a shoe that abuts against the pawl means constricting the pawl against a fastener located therein. The self energizing means may include an arc formed on a shoe having a center point that is offset from a center point of an arc formed on a flexible ring constructed adjacent the shoe.

In an embodiment, a wrench is provided comprising a handle and a flexible and resilient split ring having a mounting end integral with the handle and a free end defining a pawl, the pawl having an inner surface with serrations thereon. In an embodiment a gear insert may be mounted within the split ring. The gear insert may have a torquing surface on its inner diameter and serrations on its outer surface corresponding to the serrations on the pawl inner surface. In an embodiment a slit may separate the free end of the split ring from the handle where a first arcuate surface is formed by the split ring at the slit and a second arcuate surface is formed by the handle at the slit. In an embodiment the first arcuate surface is eccentric to the second arcuate surface and may provide a self-energizing force for the wrench. In an embodiment the first arcuate surface is concentric to the second arcuate surface and provides a self-energizing force for the wrench. In an embodiment the slit is formed generally along a radius that defines an outer edge of the split ring. In an embodiment the slit is formed generally offset from a radius that defines an outer edge of the split ring.

In a further embodiment a wrench is provided comprising a handle and a flexible and resilient split ring having a mounting end integral with the handle. The ring may have a free end at which it is split from the handle. A gear insert may be mounted within the ring. The gear insert may include a torquing inner surface and an engagement feature along its outer surface. In an embodiment the free end of the ring may be separated by a slit from a shoe on the handle. In an embodiment the split ring, shoe and slit are oriented in order to provide a self-energizing wrench that upon torquing will wrap down on a fastener located within the split ring. In an embodiment torque capacity provided by the engagement feature is greater than the torque capacity provided by the slit. In an embodiment the engagement feature includes serrations. In an embodiment the engagement feature includes a chamfered circumferential recess for receiving a chamfered circumferential projection on the ring inner surface. In an embodiment the engagement feature includes a chamfered circumferential projection protruding into a chamfered circumferential recess on the ring inner surface. In an embodiment the engagement feature includes a chamfered circumferential recess corresponding to a chamfered circumferential recess on the ring inner surface and a wire ring in compression therebetween. In an embodiment the engagement feature comprises a fluid having a high coefficient of friction.

BRIEF DESCRIPTION OF THE DRAWINGS

For the purpose of facilitating an understanding of the ratchet wrench, there is illustrated in the accompanying drawings embodiments thereof, from an inspection of which, when considered in connection with the following description, their construction and operation, and many of their advantages should be readily understood and appreciated.

DETAILED DESCRIPTION OF PRESENT EMBODIMENTS

Figure 1:
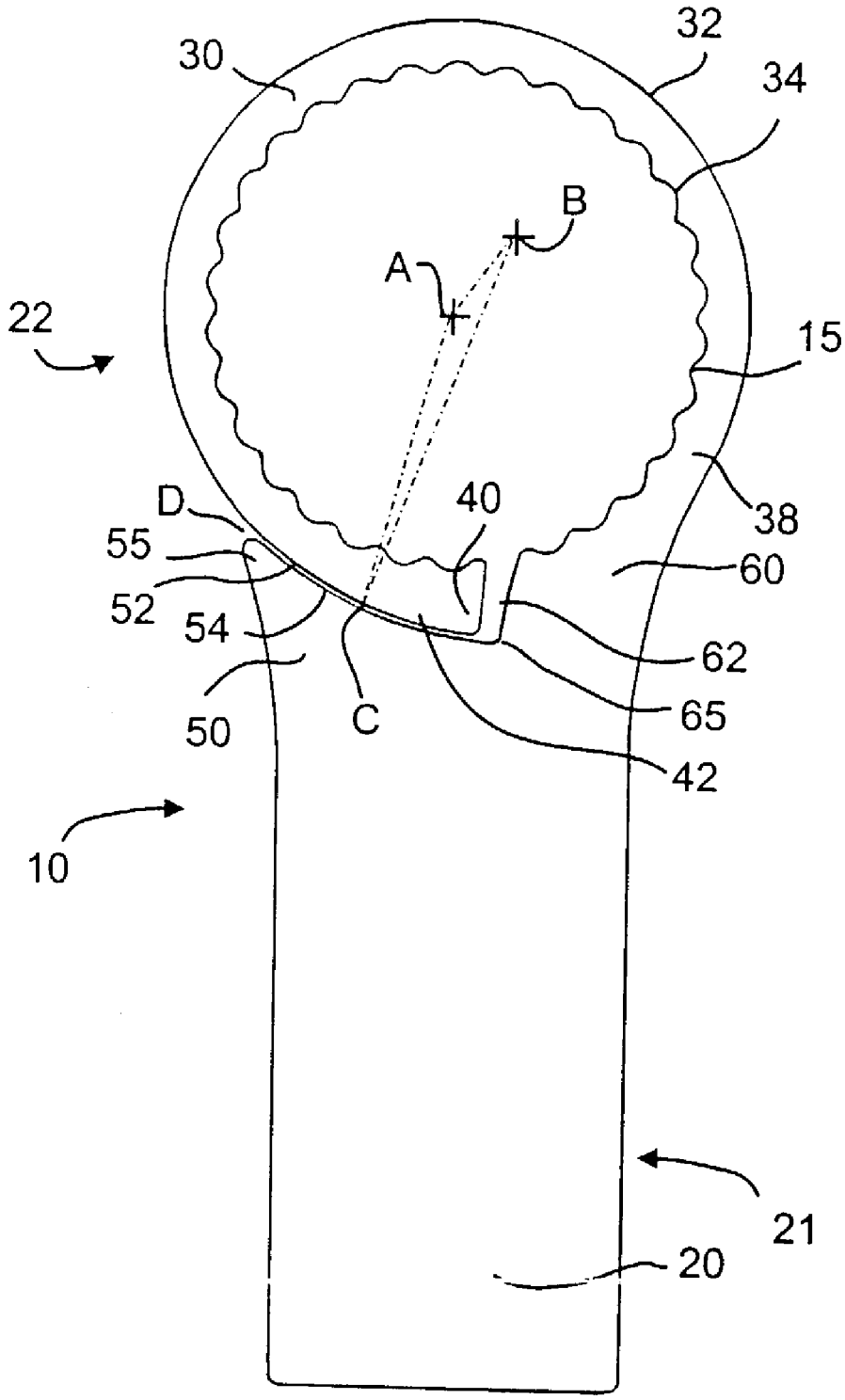
FIG. 1 is a plan view of an embodiment of a wrench with flexible ring.
Figure 2:
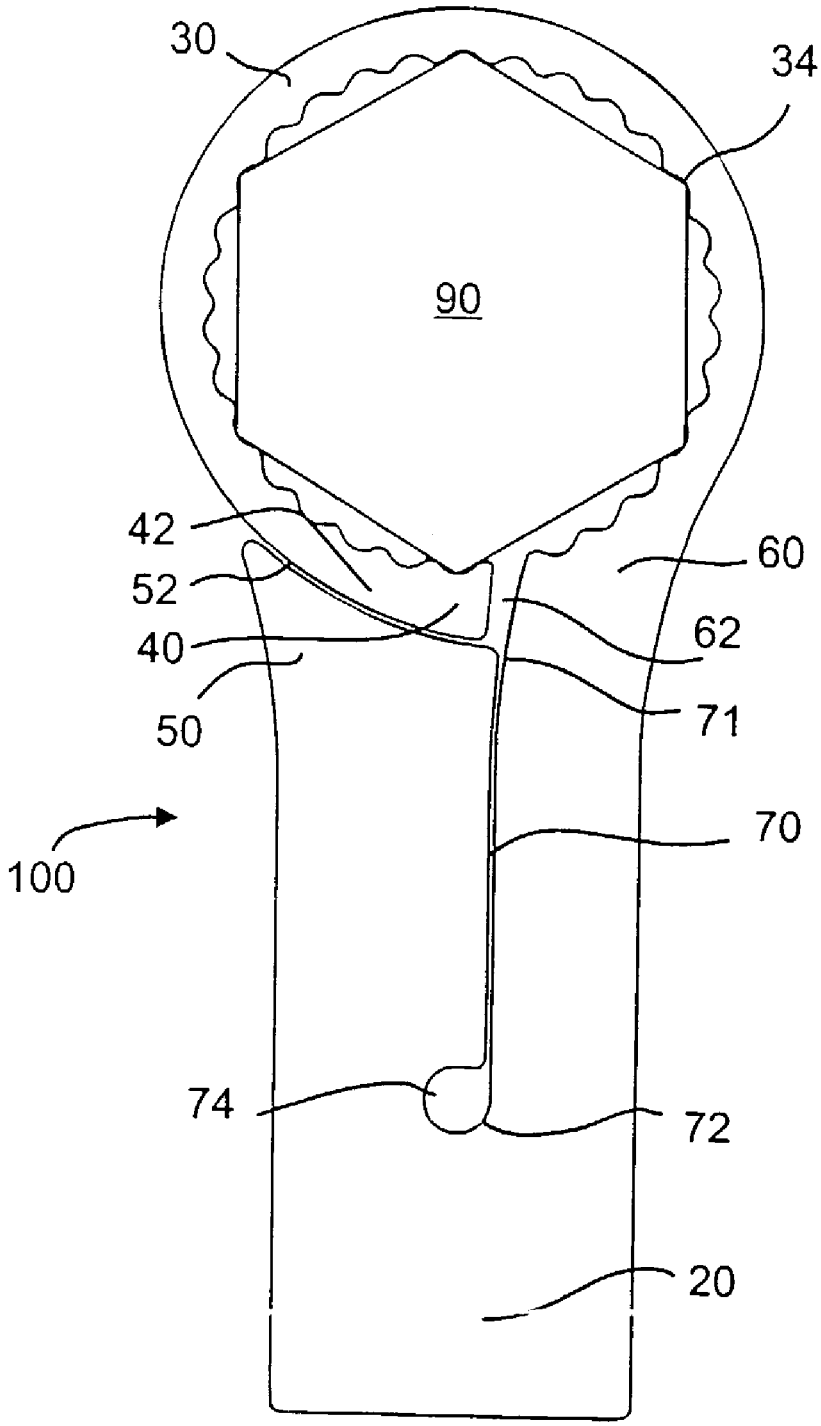
FIG. 2 is a plan view of a second embodiment of a wrench with flexible ring.
Figure 11:
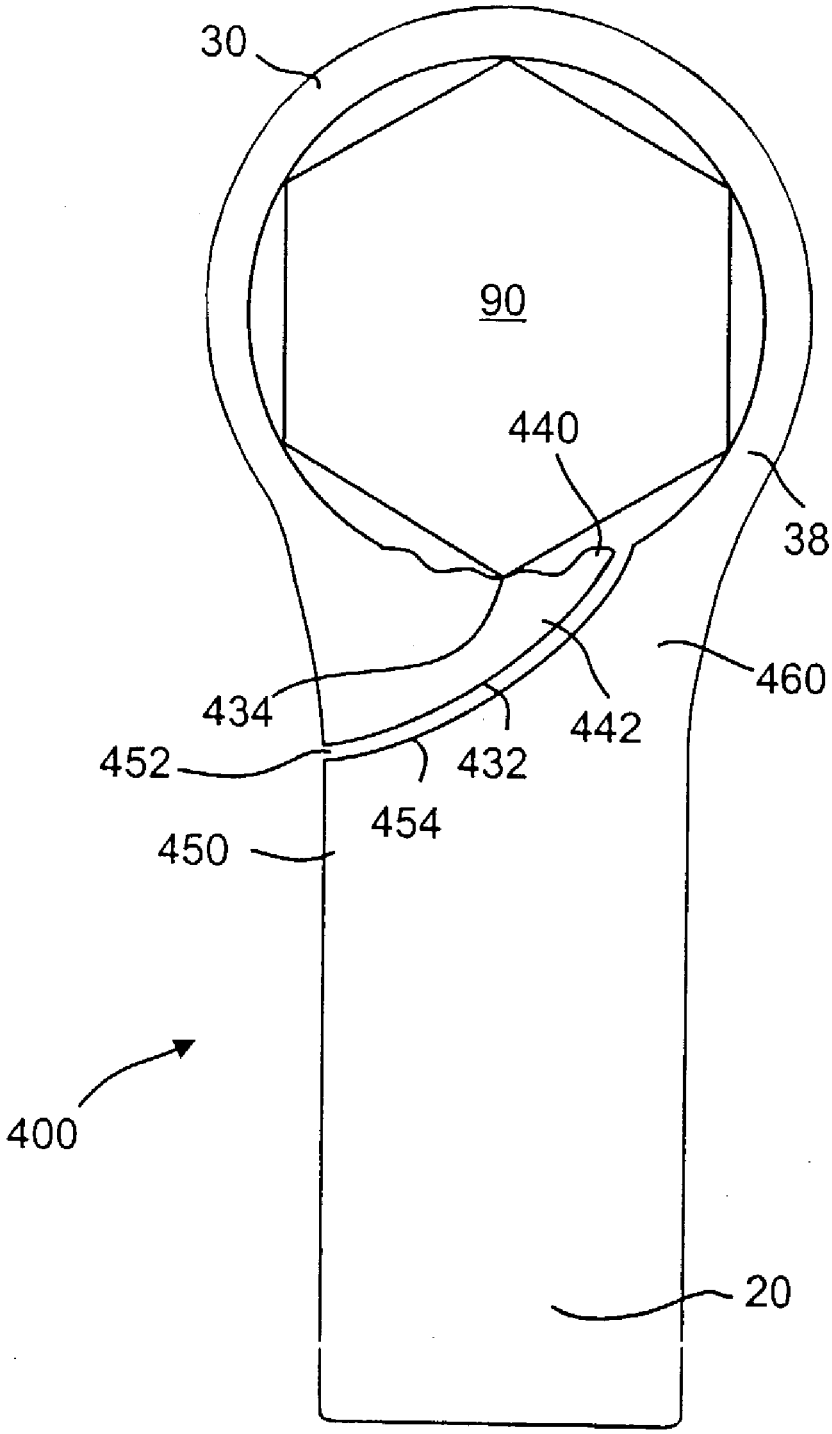
FIG. 11 is a plan view of a sixth embodiment of a wrench with flexible ring.

Referring to FIGS. 1, 2 and 11, one-piece ratcheting wrenches are disclosed. A first embodiment of a one-piece ratcheting wrench 10 is disclosed in FIG. 1. The wrench 10 includes a first end 21 that includes a handle 20. The wrench 10 includes a second end 22 which includes a flexible and resilient split ring or socket 30. The ring 30 and the handle 20 may be integrally formed of a suitable metal, such as a suitable steel. For example, a 50 B 44 steel may be used. However, other compositions of metallic or composite elements may be used to form the wrench 10. For example, fiber reinforced plastic such as glass filled nylon may be used in an embodiment. The ring 30 has an outer surface 32 which is smooth and generally cylindrically shaped. The ring 30 includes an inner surface 34 which includes serrations thereon. The serrations are formed by a plurality of teeth 15. In the embodiment shown in FIG. 1, thirty teeth 15 are disclosed. However, in an embodiment a ring 30 may have from six to thirty-six teeth 15. Teeth every 12° may be provided for a ¾" wrench. Other sized wrenches may have six teeth or more. As will be discussed in more detail below, the number of teeth 15 is dependent upon the geometry of the ring 30 in order to provide sufficient torque and also allow for ratcheting. In an embodiment, a ring having a smooth torquing surface and no serrations may still provide sufficient torque for tightening.

The ring 30 includes an attached end 38 and a free end 40. The free end 40 of the ring 30 defines a pawl 42. The pawl 42 is constructed at the free end 40 of the ring 30 in order to provide a restoring force for the pawl spring arm. Adjacent to the pawl is a shoe 50 which has an arcuate surface 54 and a toe 55. The shoe 50 is separated from the pawl 42 by a slit 52. The attached end 38 of the ring 30 is attached to the handle 20 at a tensile load bearing portion 60. The tensile load bearing portion 60 is spaced from the free end 40 of the ring 30 by a gap 62. Therefore, it can be seen that the top or working end of the handle defines the shoe 50 and the tensile load bearing portion 60.

In order for the wrench 10 to have the proper construction providing for a self energizing clamping motion of the flexible ring 30 so that, upon tightening, it will wrap down on a fastener 90 (see FIG. 2) and also to allow for ratcheting, the geometry of the ring 30 must be carefully arranged. In an embodiment, the arcuate outer surface 32, in the at-rest condition shown, has a center point A. However, the ring surface 32 is eccentric with respect to the arcuate surface 54 of the shoe 50, the latter having a center point B. In an alternate embodiment the ring surface 32 may be concentric with respect to the arcuate surface 54. When the wrench 10 is oriented, as in FIG. 1, so that the free end 40 of the ring 30 is located at about the six o'clock position, it can be seen that the center point B of the arc 54 is offset from the center point A in a direction toward the one o'clock to two o'clock positions. In an embodiment, the center points A and B are separated by approximately 0.150 inches (for a ¾" wrench). Radii drawn to the center points A and B from a point C on the arcuate surface 54 cooperate with a line between the points A and B to define an oblique triangle. Point C designates the midpoint of the arc 54 substantially midway between a toe 55 and a corner 65 and represents an effective center of the forces acting through the entire arc 54. Summation of all forces along arc 54 are represented as point C.

In an embodiment, a wrench is provided that has a self-energizing ring 30 that also has a pawl with low ratcheting torque when the orientation of points A, B and C form an oblique or acute triangle. In an embodiment, the lines between A and B and A and C represent a portion of the compression force and the line between B and C represents the tensile force between the ring 30 and the shoe 50. Maintaining this geometry provides a self-energizing force for the wrench. The self-energizing effect includes the shoe 50 acting against the resilient and flexible ring 30 causing the ring diameter to be reduced and results in the ring 30 wrapping down on a fastener. The width of the ring 30 is also an important factor in providing for a ring 30 that is sufficiently flexible and resilient to allow for self energizing and ratcheting functions. In an embodiment, the width of the ring 30 measured radially from the root of a tooth 15 to the outer surface 32, is approximately between 0.055 and 0.077 inches in a steel ¾" wrench. Another important feature is the number and size of the teeth 15 within the ring 30. In an embodiment twenty-four (24) teeth may be provided having a circular pitch of about ⅛" in a steel ¾" wrench.

Therefore, it may be understood that the wrench disclosed herein provides for a wrench head that is self energizing. The self energizing function is facilitated in an embodiment by the flexible ring 30 having an arc with a center point A and a shoe having an arc with a center point B. The orientation of the shoe arc 52 to the ring arc 32 is important in providing for a self energizing means. In an embodiment the shoe arc 52 and ring arc form tangents that meet at point D as shown in FIG. 1. Forming shoe arc and ring arc so that point D is close to the toe 55 (approximately 0.030 inches in an embodiment) provides for geometry where point B is located between the one o'clock and two o'clock position with relation to point A and results in a wrench that is self energizing. Such a self energizing wrench provides for sufficient torque to tighten standard fasteners and enough flexibility based on the width of the ring 30 and the size of the serrations 34 in order to allow for ratcheting. It is helpful for the toe 55 not to move beyond point D when it flexes upon torquing.

FIG. 2 discloses a second embodiment of a wrench 100, which has a number of elements in common with the wrench 10 of FIG. 1, so that like numerals describe like elements. The major difference in this second embodiment is a slit 70 which is provided within the handle 20. The slit runs from an open end 71 at the gap 62 down to a closed end 72, wherein a hole 74 is provided. FIG. 2 also discloses a fastener 90 located within the ring 30 having each of its six corners engaged by a serration 34 of the ring 30. The present ratchet wrench may be constructed to receive most sizes and shapes of fasteners.

The operation of the wrench will now be described with reference to FIG. 1 and FIG. 2, which depict the wrench 10, 100 at rest prior to applying any torquing or ratcheting motion. Tightening of the wrench is provided by rotation in a clockwise direction. Upon rotation of the wrench 10 or 100, the flexible ring 30 will constrict and the gap 62 will narrow. The entire circumference of the ring will clamp down onto the fastener 90 after gap 52 closes. In an embodiment, upon full torque provided on the fastener 90, the gap 62 may be diminished so that the free end 40 abuts against the wall adjacent the tensile load bearing portion 60 of the handle. The wall provides a stop abutment in order to limit the tightening compression of the ring 30. In an embodiment the slit 70 may allow for the handle to flex and provide strain relief when the free end 40 abuts against the tensile load bearing portion 60. In another embodiment the wrench 10 may be constructed so that the gap 62 will always be present and the free end 40 will not abut against the wall adjacent the tensile load bearing portion 60.

During constriction of the flexible ring 30 the separation slit 52 will narrow and the shoe arcuate surface 54 will abut against and drive the pawl portion 42 of the flexible ring 30 against the fastener 90. Upon full torquing in an embodiment (for a ¾ inch wrench) the shoe 50 may move 0.030 inches from its resting position generally tangentially around the ring 30. The toe 55 of the shoe 50 moves in a clockwise direction and at least partially toward the ring 30. Simultaneously the pawl 42 will slide along the arcuate surface 54 of the shoe 50 and close the gap 62, causing the ring 30 to clamp down on the fastener 90. In other embodiments a wrench may be provided wherein the shoe 50, upon full torquing may move by various amounts from the shoe's resting position and not close the gap 62.

When the wrench is turned in a counterclockwise (non-torquing) direction in the embodiments shown in FIGS. 1–2, the ring 30 loosens and unwraps from the fastener 90. The pawl 42 at the free end 40 of the ring 30 loosens from the fastener and moves so that the outer surface of the pawl moves outwardly toward the shoe 50. The flexing of the pawl 42 away from the fastener and toward the shoe 50 provides enough clearance between the serrations 34 of the pawl 42 and the corners of the fastener 90 so that ratcheting may occur. Such ratcheting is accomplished by the pawl 42 sliding back and forth in an oscillatory motion, its natural resilience urging it toward its rest position. In an embodiment, the slit 52 is sufficiently wide that it doesn't close during ratcheting. The orientation of the pawl 42 at the end of the flexible ring 30 provides for a restoring force to urge the pawl against the fastener 90 when the pawl teeth are ratcheting alone the fastener (or along the teeth of the gear insert 210 of the embodiment of FIG. 3, discussed below). The teeth 15 of the ring 30 are dimensioned so that at the maximum deflection of the pawl, when the apex of a pawl tooth 15 is abutting the apex of the corner of the fastener (or the teeth of the gear insert 210 of the embodiment of FIG. 3) enough clearance is provided by the slit 52 so that the pawl 42 will not abut against the shoe arc 50. Additional clearance may be provided to provide extremely low ratcheting torque in the second embodiment shown in FIG. 2, wherein the slit 70 and the hole 74 provide for strain relief during ratcheting.

In an embodiment, the wrench 10, 100, 200, 300, 400, 500 may be manufactured according to the following process. A one-piece forged wrench is provided having a first end including a handle to a second end including a solid disk. A central portion of the disk is removed to form a hole that defines the ring 30 by drilling and broaching. In an embodiment the hole that is broached is circular in shape. In an alternate embodiment the shape may be any form that provides for a pre-load on the gear insert 210 when mounted in the hole. For example, the hole may be oval. The wrench is formed of steel. In an embodiment, 50 B 44 steel is used. However, any steel providing the proper flexibility and strength may be used. The wrench is then heat treated. After cooling, the wrench in an embodiment is then placed in a wire EDM (electrodischarge machining) machine. A cut is made to form the separation slit 52 and the gap 62 forming the free end 42 of the ring 30 and separating it from the shoe 50. The cut is made from the outside of the handle toward the inside of the handle toward gap 62. In an embodiment, the cut is 0.010 inches wide. In an embodiment the cut is widened at the gap 62. In an embodiment, the wire EDM machine is fitted so that wrenches may be manufactured in multiple batches one after another. In an embodiment the cutting may also be accomplished by a laser, water jet, saw or other narrow slit-forming processes. The process may be further automated by use of pick and place machinery to quickly load and unload wrenches to be cut.

Figure 3:
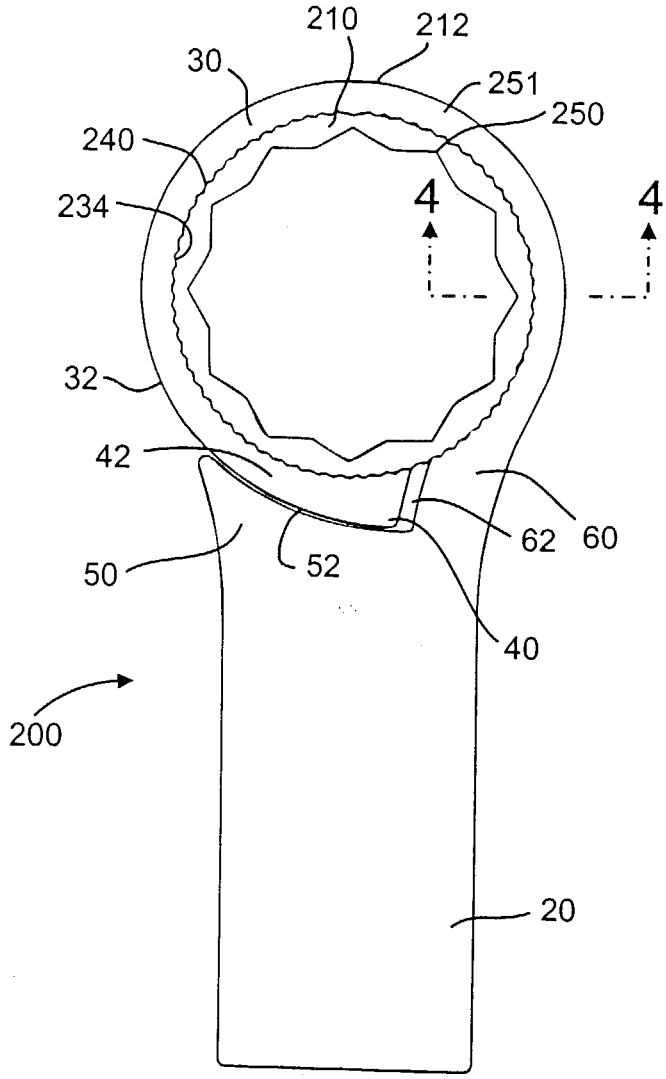
FIG. 3 is a plan view of a third embodiment of a wrench with flexible ring.

Referring to FIGS. 3–10, ratcheting wrenches having more than one piece are disclosed. FIG. 3 discloses a third embodiment of a wrench 200, wherein like numerals designate the elements in common with other embodiments, discussed previously. Generally, the wrench 200 is similar to that shown in FIG. 1, having a handle 20 and flexible ring 30. In this embodiment, however, the ring includes more numerous serrations 234 and mounted within the ring 30 is a gear insert 210. The gear insert along its outer surface has serrations 240 which mesh with the serrations 234 on the ring 30. In an embodiment the gear insert 210 includes one hundred and ten serrations 240 on its outer surface and the ring 30 includes one hundred nine serrations 234 on its inner surface. In an embodiment the serrations 234, 240 have a circular pitch of 0.026 inches. In an embodiment, prior to insertion of the gear insert 210 within the ring 30, the gap 62 is very small and is generally smaller than the width of a serration 240 of the embodiment provided. Upon insertion of the gear insert 210 into the ring 30 it is expanded and the gap 62 is spread so that its width is approximately equal to the width of a tooth 240. Therefore, it may be understood that the gap occupies the space of the extra, or one hundred and tenth serration 240 of the gear insert 210. In an embodiment, the gap may occupy the space of more than one serration. In addition, the assembly of the wrench 200 in such a manner provides for the pawl 42 to be preloaded alter the gear insert 210 is mounted therein.

The gear insert 210 has along its inner surface a double hex pattern 250. In an additional embodiment the gear insert 210 may be a solid disk having a square drive protruding from its center so that the wrench can function as a ratchet head. It may be understood that all such embodiments of the gear inserts 210 may be used interchangeably on the same wrench 10, 100, 200, 500 (discussed below). The wrench 10, 100, 200, 500 may also be provided with interchangeable gear inserts 210 having multiple sized hex inner surfaces 250. In this way, a single wrench 200 may be used to tighten or loosen multiple fastener sizes. In an embodiment, the gear insert may be formed of steel 50 B 44. In alternative embodiments the insert 210 may be other metal composite, polymer or resin materials sufficient to provide durability and limited resiliency.

Figure 4:
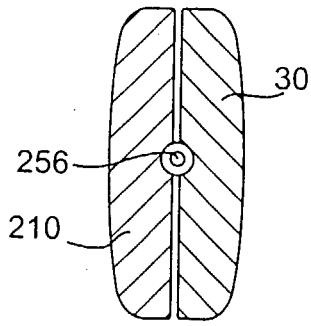
FIG. 4 is a cross sectional view of the wrench depicted in FIG. 3 taken at line 4—4.

FIG. 4 discloses an embodiment depicting the mounting of the gear insert 210. FIG. 4 depicts a sectional view taken at line 4—4 of FIG. 3. An internal retaining ring 256 may be installed at the center height within circumferential grooves formed axially midway on the outer surface of the gear insert 210 and the inner surface of the flexible ring 30 so that a shoulder or external retaining ring would not be required. This design allows for a wrench of narrow height or low profile. In an embodiment, the internal retaining ring 256 may be formed separately from either the gear insert 210 or flexible ring 30. In an alternative embodiment, the internal retaining ring 256 may be formed integrally or be of one-piece with either the ring 30 or insert 210. The gear insert 210 may be snapped in place within the ring 30.

Figure 5:
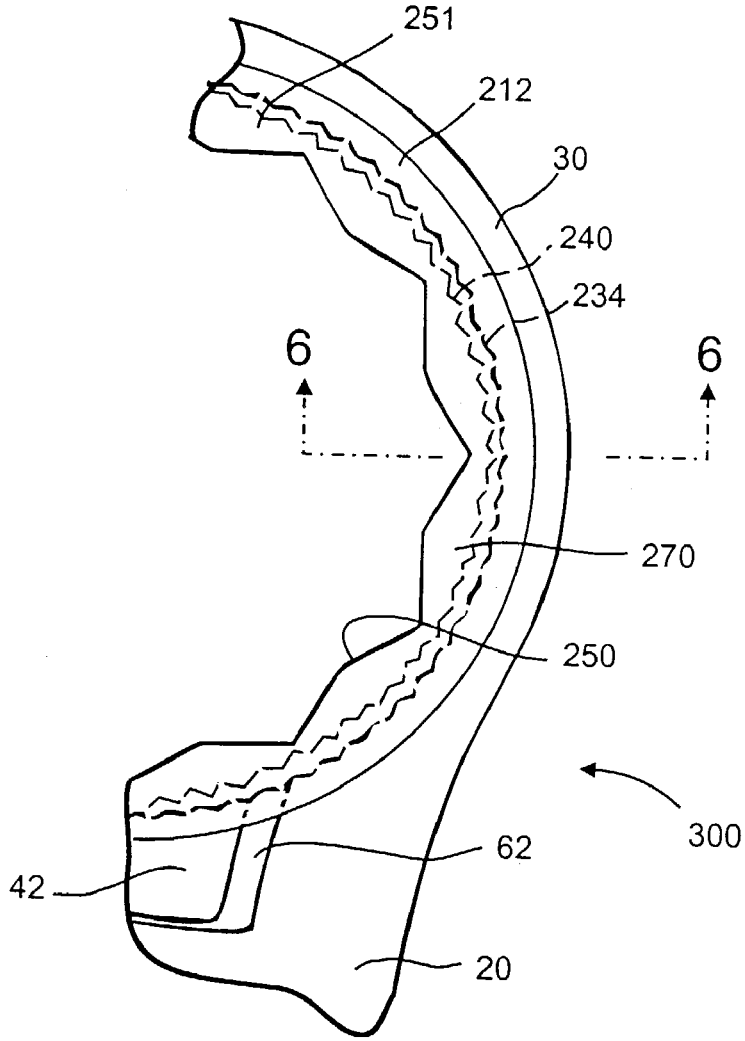
FIG. 5 is an enlarged fragmentary view of a portion of a fourth embodiment of a wrench with flexible ring.
Figure 6:
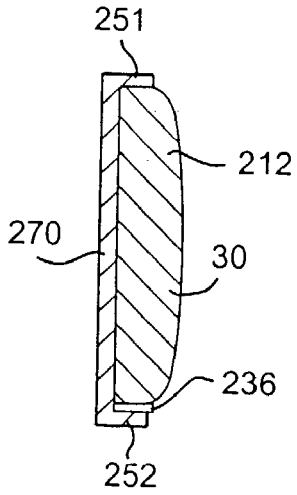
FIG. 6 is a cross-sectional view of the wrench depicted in FIG. 5 taken at line 6—6.

FIG. 5 discloses a fourth embodiment of the invention. The wrench 300 is shown in an enlarged and sectioned view only depicting an upper side of the wrench 300. Some numerals are the same as previous embodiments and describe like parts. The portions of the wrench that are not depicted in FIG. 5 may be assumed to operate consistent with the description provided previously. The wrench 300 includes handle 20 which is formed as one piece with flexible ring 30. The ring 30 is cylindrical, identical to that in FIG. 3 and has a free end which forms a pawl 42 as described previously. A gap 62 is provided between pawl 42 and tensile load bearing portion 60. Just as FIG. 3 depicted a wrench 200 having a three-piece design, FIG. 5 depicts an alternative three-piece design. Referring also to FIG. 6, mounted within the ring 30 is a gear insert 270 having serrations 240 on its outer surface and an inner torquing surface 250. The ring 30 includes serrations 234 on its inner surface. In an embodiment the torquing surface 250 is a double hex. In other embodiments the torquing surface 250 may be hex or other shape or smooth. FIG. 6 discloses a sectional view of FIG. 5 taken at line 6—6. The flexible ring 30 is shown having the gear insert 270 mounted thereon with a rim 251 riding on a shoulder 212 of the ring 30. A retaining ring 236 is provided in order to retain the gear insert 20 on the flexible ring 30. In an embodiment other means of retaining the gear insert 210 on the ring 30 may be provided. On the bottom of the gear insert 270 is a lip 252. The retaining ring 236 is inserted under the lip 252. While the inside of the retaining ring is located under the lip 252, the outside edge of the retaining ring 236 rides on top of the flexible ring 30 in order to secure the insert 270 in place.

The wrenches 200, 300 operate in a similar fashion as the one-piece wrenches discussed previously, in that upon rotation in a clockwise tightening direction, the flexible ring 30 will wrap down against the gear insert 210, 270 causing serrations 234 to engage corresponding serrations 240 and prohibit the gear insert 210, 270 from rotating relative to the ring 30. The torquing surface or double hex 250 of the gear insert 210, 270 will engage the corners of a fastener and provide for tightening. Where additional torque is required to tighten, the ring 30 continues to wrap down tightly against the gear insert 210, 270 where the serrations 234 tightly engage serrations 240 of the gear insert 210, 270 and the free end 42 moves into the gap 62. In an embodiment, the ring outer surface 32 may be eccentric or concentric to the arcuate surface 52 of the shoe 50 (FIG. 3) in order to provide a self-energizing force for the wrench.

Similar to the functioning described above, upon rotation in a counterclockwise direction, the flexible ring 30 will unwrap from the gear insert 210, 270 and the serrations 234 of the ring 30 will separate slightly from the serrations 240 of the gear insert and allow for a ratcheting between the serrations 234 and 240. The pawl 42 has a restoring force and flexes away from the gear insert 210, 270 and the serrations 234 of the pawl 42 move on and off of the serrations 240 of the gear insert 210, 270 as the pawl 42 slides back and forth adjacent the shoe 50. Therefore, it may be understood that the wrench may be easily moved between a clockwise tightening rotation and counterclockwise ratcheting rotation in order to tighten down a fastener in a rapid sequence.

In order to loosen a fastener 90, any of the wrenches 10, 100, 200, 300, 400, 500 is flipped over to its opposite side and loosening is provided in the counterclockwise direction and ratcheting in the clockwise direction.

FIGS. 7–10 depict a fifth embodiment of a wrench 500. The wrench 500 is similar to the wrenches 200, 300 described above for FIGS. 3–6, and like numerals identify like parts in each Figure; however, the main difference of the wrench 500 is that its insert 510 does not have serrations on its outer surface. Correspondingly the inner surface of flexible ring 30 is also non-serrated. The two facing surfaces of the ring 30 and insert 510 are substantially smooth except for a circumferential engagement feature 550 located in an embodiment at an axial midpoint of both the insert 510 and the ring 30. In an embodiment, the inner surface of the insert 510, much like the previous embodiments, may have a torquing surface 250 at its inner surface. The torquing surface 250 in an embodiment may be hex or serrated. In other embodiments the torquing surface 250 may double hex, or other shape or smooth.

The engagement feature 550 of the wrench 500 may be formed according to many structures that provide for the engagement of two side-by-side members and will allow insert 510 to rotate within flexible ring 30 and free end 40 to withdraw from the insert 510. For example, the engagement feature 550 provided by the previous embodiments were serrations 234, 240 (FIGS. 3, 5) as have been described above on both the insert 510 and the ring 30. Referring to FIG. 8 another embodiment of an engagement feature is depicted. FIG. 8 is a sectional view of the wrench 500 of FIG. 7 taken at line 8—8. Engagement feature 550 comprises projection 551 protruding from the flexible ring 30 and received by a recess 552 of insert 510. The projection 551 in an embodiment may have tapered sides at its distal end forming a chamfer and the recess 552 will also have correspondingly tapered walls or chamfered sides. A gap 555 is provided between the tip of the projection 551 and the bottom of recess 551. Gap 555 is provided to reduce wear between the projection 551 and the recess 552. In an embodiment the projection 551 and recess 552 (as are the insert 510 and ring 30 on which they reside, respectively) are formed of steel. The hardness of the insert 510 may be greater than that of the projection 551 in order to reduce wear.

Figure 7:
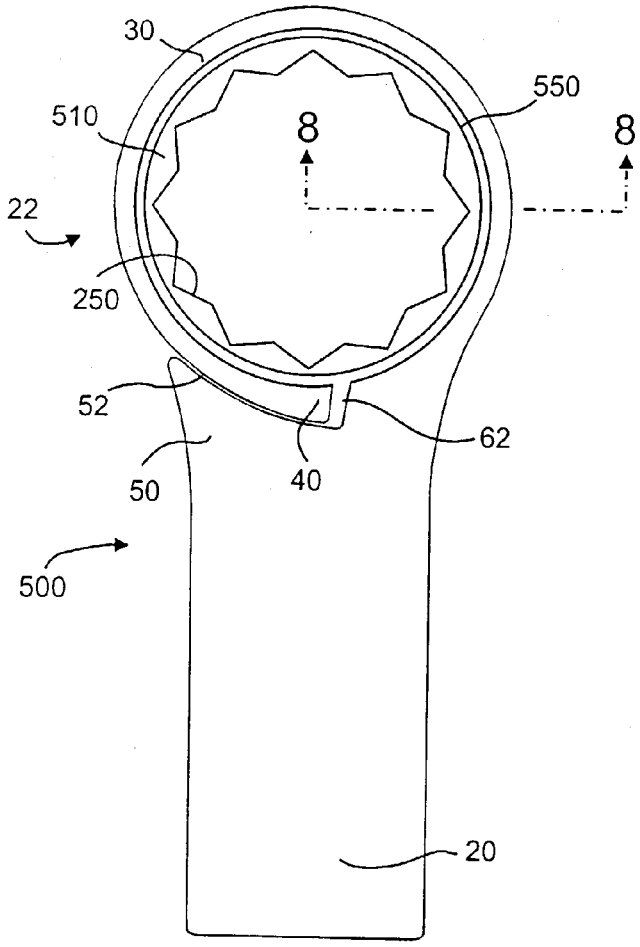
FIG. 7 is a plan view of a fifth embodiment of a wrench with flexible ring.
Figure 8:
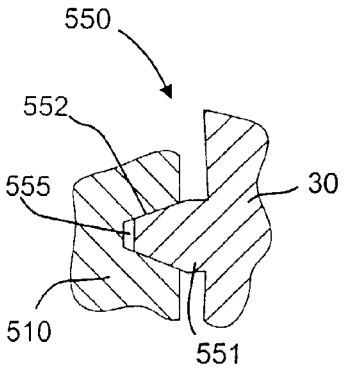
FIG. 8 is a cross-sectional view of the wrench depicted in FIG. 7 taken at line 8—8.
Figure 9:
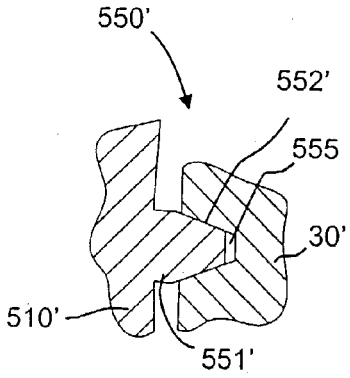
FIG. 9 is a view similar to FIG. 8 depicting an alternate embodiment.

Turning to FIG. 9 an additional embodiment of engagement feature 550' is depicted in a manner similar to FIG. 7. In the embodiment of FIG. 9 the projection 551' is protruding from the insert 510' and the recess 552' is provided in the ring 30'. This is the inverse arrangement of FIG. 8. Both the embodiments of FIGS. 8 and 9 may be considered two-piece ratcheting wrench configurations.

Figure 10:
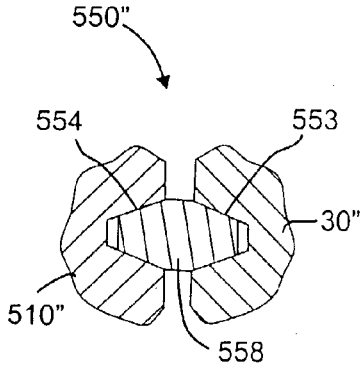
FIG. 10 is a view similar to FIG. 8 depicting a further alternate embodiment.

Turning to FIG. 10, an additional embodiment is depicted of the wrench 500. FIG. 10 is similar to FIG. 7. In the embodiment of FIG. 10 the engagement feature 550" comprises a first recess 553 in the ring 30" and a second recess 554 in the insert 510". Located within the recesses 553, 554 and held by compression between the insert 510" and the ring 30" is a wire ring 558. In an embodiment the wire ring 558 may be a belt or strap formed of any materials such as rubber, metal, composites, polymer, ceramic, glass, plastic, etc. In an embodiment the wire ring 558 is split at a point around its circumference so that upon rotation of the insert 510 the wire ring 558 may change in diameter.

For all embodiments shown in FIGS. 8–10, the engagement feature 550, 550', 550" must have a geometry that generates a torque capacity between the recess 552, 552' and projection 551, 551' or between the wire ring 558 and the recesses 553, 554 (torque capacity of the insert or Ti) that is greater than the torque capacity generated between the pawl 42 and shoe 50 (torque capacity of the shoe or Ts). In an embodiment this ratio of torque capacities may be provided by the wrenches 10, 100, 200, 300, 400 and 500 described herein and the structures and geometries provided herein. In an embodiment such a torque capacity ratio Ti>Ts provides a self energizing wrench. It may be understood that as the wrench 500 is torqued the ring 30 wraps down on the insert 510 (as has been describe previously for the above described embodiments that provide a self-energizing wrench) and forces projection 551, 551', 558 into recess 552, 552', 553, 554 generating torque. Because the slit 52 has smooth surfaces on each side in an embodiment Ti>Ts allowing the ring to continue to wrap down, increasing torque further and allowing the torquing surface 250 or hex to act against a fastener (not shown) and tighten (or loosen) the fastener. The construction of the wrench 500, having an engagement feature 550 and slit 52 that provide Ti>Ts maintain a self-energizing wrench.

When the wrench 500 is rotated in a non-torquing direction the ring 30 un-wraps (as has been discussed for previous embodiments) and the projection 551, 551', 558 withdraws from the recess 552, 552', 553, 554 reducing torque allowing the wrench 500 to rotate in one direction while the insert 510 remains stationary with the fastener located therein. Therefore the wrench 500 may not necessarily have a pawl (see pawl 42 of FIGS. 1–3) that may "ratchet" or "click" because the ring 30 does not have serrations. However, the wrench 500 includes a free end 40 of the ring 30 that, upon rotation in a non-torquing direction, via the engagement features (discussed above) continues to provide a ratcheting type function wherein the gear-insert is prevented from spinning freely or counter-rotating but may remain stationary during the reorientation of the wrench 500 handle 20 (in an embodiment a counter-clockwise rotation) to a position able to provide a torquing stroke. In an embodiment, the engagement feature 550 may be a fluid having a high coefficient of friction coated on the inner surface of the ring 30 and the outer surface of the insert 510. In order to provide or enhance the Ti>Ts relationship in an embodiment the slit 52 may be treated so that a slippery surface, such as Teflon™, is applied to the shoe 50 arc and the free end 40 outside arc. In an embodiment, such treatment of the surfaces with fluids and the like, may be combined with the above discussed engagement features 550 including coating the projections 551, 551', 558 and recesses 552, 552', 553, 554.

FIG. 11 discloses a sixth embodiment of a one-piece wrench 400 which has a number of elements in common with the wrench 10 of FIG. 1, so that like numerals describe like elements. The ring 30 includes an attached end 38 and a free end 440. The free end 440 of the ring 30 defines a pawl 442. The pawl 442 is constructed at the free end 440 of the ring 30 in order to provide a restoring force for the pawl spring arm 442. Adjacent to the pawl is a shoe 450 which has an arcuate surface 454. The shoe 450 is separated from the pawl 442 by a slit 452. The attached end 38 of the ring 30 is attached to the handle 20 at a tensile load bearing portion 460. Therefore, it can be seen that the top or working end of the handle defines the shoe 450 and the tensile load bearing portion 460. During constriction of the flexible ring 30 the separation slit 452 will narrow and the shoe arcuate surface 454 will abut against and drive the pawl portion 442 of the flexible ring 30 against the fastener 90. Upon full torquing in an embodiment, the shoe 450 may move from its resting position generally tangentially around the pawl 442. Simultaneously the pawl 442 will slide along the arcuate surface 454 of the shoe 450, causing the ring 30 to clamp down on the fastener 90.

When the wrench is turned in a counterclockwise (non-torquing) direction in the embodiment shown in FIG. 11, the ring 30 loosens and unwraps from the fastener 90. The pawl 442 at the free end 440 of the ring 30 loosens from the fastener and moves so that the outer surface of the pawl moves outwardly toward the shoe 450. The flexing of the pawl 442 away from the fastener and toward the shoe 450 provides enough clearance between the serrations 434 of the pawl 442 and the corners of the fastener 90 so that ratcheting may occur. Such ratcheting is accomplished by the pawl 442 sliding back and forth in an oscillatory motion, its natural resilience urging it toward its rest position. In an embodiment the slit 452 is sufficiently wide that it doesn't close during ratcheting. The orientation of the pawl 442 at the end of the flexible ring 30 provides for a restoring force to hold the pawl against the fastener 90 during ratcheting. The teeth 434, in an embodiment, do not extend along the entire inner surface of the ring 30. In an embodiment, only three teeth 434 may be necessary in order to provide sufficient ratcheting. The inner surface of the ring 30 is substantially smooth in the embodiment of FIG. 6 and is sufficient to provide enough friction on the corners of the fastener 90 during clockwise (torquing) rotation when the ring wraps down on the fastener in order to tighten the fastener 90. The orientation of the arcuate surface 454 of the shoe 450 in an embodiment may be eccentric or concentric to the outer surface 432 of the ring 30 at the portion forming the slit 452 in order to provide a self-energizing force for the wrench 400. As well, the arc 432 and arc 454 may or may not have equal radii.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution.

What is claimed is:

1. A wrench comprising:

a first end including a handle;

a second end including a flexible ring having an inner surface having serrations; and the flexible ring having an attached end integrally formed with and attached to the handle at a tensile load bearing portion, a free end defining a pawl which abuts a shoe adjacent the tensile load bearing portion, the shoe forming an arc which is eccentric relative to an arc formed by an outer surface of the ring, and flexibility and resilience such that upon rotation of the wrench in a torquing direction the flexible ring wraps down on a fastener.

2. The wrench of claim 1, wherein the serrations provided on the inner surface of the pawl ratchet past the fastener when the wrench is rotated in a non-torquing direction.

3. The wrench of claim 1, wherein the shoe provides for a self energizing force against the pawl.

4. The wrench of claim 1, wherein the arc of the shoe has a center point B and the ring outer surface has a center point A, wherein center points A and B are offset from each other.

5. The wrench of claim 4, wherein the arc of the shoe has a midpoint C and an oblique triangle is defined by points A, B and C.

6. The wrench of claim 4, wherein the wrench is oriented so that the free end of the ring is located at about a six o'clock position when the handle is pointing down and wherein the center point A is located at the center of the ring and the center point B of the shoe arc is located offset from center point A between about the one and two o'clock positions.

7. The wrench of claim 1, wherein the ring includes from about 6 to about 36 teeth forming serrations.

8. The wrench of claim 7, wherein the wrench is ¾" nominal size.

9. The wrench of claim 8, wherein the ring has 30 teeth.

10. A wrench comprising:

a first end including a handle;

a second end including a flexible ring having an inner surface having serrations; and the flexible ring having an attached end integrally formed with the handle at a tensile load bearing portion and adjacent the tensile load bearing portion is a shoe having an arcuate surface that forms an arc, a free end defining a pawl which abuts the shoe, a slit formed in the handle between the tensile load bearing portion and the shoe, and flexibility and resilience such that upon rotation of the wrench in a torquing direction the flexible ring wraps down on a fastener.

11. The wrench of claim 10, wherein the slit has a hole formed at its closed end wherein the slit and the hole provide a strain relief.

12. A wrench comprising:

a first end including a handle;

a second end including a flexible ring having an inner surface having serrations;

a gear insert located within the ring; and wherein the flexible ring comprises an attached end integrally formed with the handle, a free end defining a pawl, and flexibility and resilience such that upon rotation of the wrench in a torquing direction the flexible ring wraps down on a fastener.

13. The wrench of claim 12, wherein the gear insert includes an outer surface having serrations adjacent to the serrations of the inner surface of the ring.

14. The wrench of claim 13, wherein the serrations of the outer surface correspond in size and number to the serrations of the ring wherein upon movement of the wrench in a direction that is non-torquing the pawl will ratchet relative to the gear insert.

15. The wrench of claim 14, wherein the gear insert includes a rim that rides on a shoulder of the ring.

16. The wrench of claim 15, wherein the gear insert includes a circumferential retaining ring.

17. The wrench of claim 13, wherein the gear insert is one piece and is retained axially to the ring by a single retaining ring resting in grooves in both the gear insert and the ring, the grooves located at a midpoint of each of the gear insert and the ring.

18. The wrench of claim 13, wherein the gear insert includes a torquing surface serration pattern on its inner surface.

19. The wrench of claim 18, wherein the gear insert includes a hex torquing surface.

20. The wrench of claim 18, wherein the gear insert includes a double hex torquing surface.

21. The wrench of claim 13, wherein the gear insert includes one more serration on its outer surface than the number of serrations on the ring.

22. The wrench of claim 13, wherein the gear insert is one piece.

23. A one-piece wrench comprising:

a first end having a socket having, along an inner surface, means for applying torque;

pawl means on the socket for ratcheting against a fastener located within the socket; and the socket including a self energizing means so that upon rotation of the wrench in a tightening direction the socket will clamp down on a fastener.

24. The wrench of claim 23, wherein the means for applying torque includes serrations on the socket.

25. The wrench of claim 23, wherein the self-energizing means includes a flexible and resilient ring forming the socket, the ring having a free end that allows the ring to clamp down on the fastener.

26. The wrench of claim 25, wherein the pawl means includes the free end of the flexible ring having serrations thereon.

27. The wrench of claim 23, wherein the self-energizing means includes a handle having a shoe that abuts against the pawl means constricting the pawl means against a fastener located in the socket.

28. The wrench of claim 23, wherein the self-energizing means includes an arc formed on a shoe having a center point that is offset from a center point of an arc formed on a flexible ring constructed adjacent the shoe.

29. A wrench comprising:

a handle and a flexible and resilient split ring having a mounting end integral with the handle and a free end defining a pawl, the pawl having an inner surface with serrations thereon so that upon rotation of the wrench in a first direction the pawl will flex toward a center of the ring.

30. The wrench of claim 29, and further comprising a gear insert mounted within the split ring, the gear insert hang an inner torquing surface and serrations on its outer surface corresponding to the serrations on the pawl inner surface.

31. The wrench of claim 29, and further comprising a slit separating the free end of the split ring from the handle, a first arcuate surface being formed by the split ring at the slit and a second arcuate surface being formed by the handle at the slit.

32. The wrench of claim 31, wherein the first arcuate surface is eccentric to the second arcuate surface and provides a self-energizing force for the wrench.

33. The wrench of claim 31, wherein the first arcuate surface is concentric with the second arcuate surface and provides a self-energizing force for the wrench.

34. The wrench of claim 31, wherein the slit is formed generally along a radius that defines an outer edge of the split ring.

35. The wrench of claim 31, wherein the slit is formed generally offset from a radius that defines an outer edge of the split ring.

36. A wrench comprising:

a handle and a flexible and resilient split ring having a mounting end integral with the handle, the ring having a free end at which it is split from the handle; and an insert mounted within the ring, the insert including a torquing inner surface and an engagement feature along its outer surface, wherein upon rotation of the wrench in a first direction the free end of the ring will flex down on the insert.

37. The wrench of claim 36 wherein the free end of the ring is separated by a slit from a shoe on the handle.

38. The wrench of claim 37 wherein the split ring, shoe and slit are oriented in order to provide the flex of the ring.

39. The wrench of claim 38 wherein torque capacity provided by the engagement feature is greater than the torque capacity provided by the slit.

40. The wrench of claim 39 wherein the engagement feature includes serrations.

41. The wrench of claim 39 wherein the engagement feature is a recess for receiving a chamfered circumferential projection on the ring inner surface.

42. The wrench of claim 39 wherein the engagement feature is a chamfered circumferential projection protruding into a chamfered circumferential recess on the ring inner surface.

43. The wrench of claim 39 wherein the engagement feature comprises a chamfered circumferential recess corresponding to a chamfered circumferential recess on the ring inner surface and a ring in compression therebetween.

44. The wrench of claim 39 wherein the engagement feature comprises a fluid having a high coefficient of friction coated on the inner surface of the ring and the outer surface of the insert.

45. The wrench of claim 39 wherein the engagement feature provides for torque capacity $Ti>Ts$.

* * * * *

UNITED STATES PATENT AND TRADEMARK OFFICE

CERTIFICATE OF CORRECTION

PATENT NO. : 6,988,430 B1
APPLICATION NO. : 10/342696
DATED : January 24, 2006
INVENTOR(S) : Gordon A. Putney et al.

It is certified that error appears in the above-identified patent and that said Letters Patent is hereby corrected as shown below:

Column 13

Claim 30, line 46; "hang" should be --having--.

Signed and Sealed this

Eighteenth Day of July, 2006

JON W. DUDAS
*Director of the United States Patent and Trademark Office*